US006523549B1

(12) United States Patent
Frame et al.

(10) Patent No.: US 6,523,549 B1
(45) Date of Patent: Feb. 25, 2003

(54) HAIR ORNAMENT RETAINING IMPLEMENTS AND METHOD

(76) Inventors: Bridget R. Frame, 1920 Parkview, Rock Springs, WY (US) 82901; Stanley D. Goodman, 691 Birchwood Dr., Wyckoff, NJ (US) 07481

( * ) Notice: Subject to any disclaimer, the term of this patent is extended or adjusted under 35 U.S.C. 154(b) by 0 days.

(21) Appl. No.: 09/993,047

(22) Filed: Nov. 6, 2001

(51) Int. Cl.[7] ..... A45D 8/12
(52) U.S. Cl. ..... 132/275
(58) Field of Search ..... 132/273, 275, 132/280, 283, 284, 200; 24/16 R, 30.5 S, 30.5 T

(56) References Cited

U.S. PATENT DOCUMENTS

| | | | | | |
|---|---|---|---|---|---|
| 482,257 | A | * | 9/1892 | Larkin | 132/280 |
| D50,981 | S | | 7/1917 | Creech et al. | |
| D52,947 | S | | 2/1919 | Creech et al. | |
| 1,564,301 | A | * | 12/1925 | Wilson | 24/30.5 T |
| 1,618,385 | A | | 2/1927 | Pearson | |
| 1,873,543 | A | * | 8/1932 | Carlson | 132/280 |
| 1,953,531 | A | * | 4/1934 | Casper | 132/280 |
| 2,375,935 | A | * | 5/1945 | McDonald | 132/284 |
| 3,144,028 | A | * | 8/1964 | Sawyer | 132/284 |
| 3,536,746 | A | | 10/1970 | Thomas, Jr. | |
| 3,587,595 | A | | 6/1971 | Popeil | |
| 5,271,421 | A | * | 12/1993 | Videtzky | 132/200 |
| D347,493 | S | | 5/1994 | Connolly | |
| 5,318,054 | A | | 6/1994 | Neilson et al. | |
| D364,482 | S | | 11/1995 | Hsu | |
| D368,150 | S | | 3/1996 | Pereira | |
| 5,566,690 | A | | 10/1996 | Shih-Ming | |
| 5,694,955 | A | * | 12/1997 | Grooms | 132/273 |
| 5,797,408 | A | * | 8/1998 | Wilson | 132/275 |

* cited by examiner

*Primary Examiner*—Todd E. Manahan
(74) *Attorney, Agent, or Firm*—Arthur Jacob

(57) ABSTRACT

A hair ornament retaining implement includes a band of resiliently deflectable material having a normally open loop for receiving multiple strands of hair of an individual, and integral legs for being selectively intertwined to close the loop and cinch the multiple strands of hair so as to secure the implement to the hair. The band carries a coupling element for coupling the hair ornament to the band so as to retain the ornament on the hair for decorating the hair. A hair appliance employs a decorative cord coupled to a plurality of the implements for extending between the implements and decorating the hair when the implements are secured to the hair.

20 Claims, 5 Drawing Sheets

HAIR ORNAMENT RETAINING IMPLEMENTS AND METHOD

The present invention relates generally to decorating an individual's hair and pertains, more specifically, to implements and method for retaining ornamental items on the head of a person through ready and convenient attachment to the person's hair.

Throughout time immemorial, people have employed a very wide variety of ornamental devices to decorate themselves and, in particular, to enhance the appearance of the hair on their heads. Women, especially, have sought new and unique ornamental arrangements for accentuating the beauty of their hair in efforts to increase their attractiveness.

The present invention provides hair ornament retaining implements and method by which a person's hair is uniquely decorated with ease and versatility. As such, the present invention attains several objects and advantages, some of which are summarized as follows: Provides exceptionally simple and highly effective implements and method for retaining ornaments in strands of a person's hair; allows convenient and economical decoration of a person's hair with a very wide variety of ornamental items; enables a very high degree of versatility in accomplishing a myriad of decorative effects for the hair, with minimal expense; attains new and unique aesthetic effects in the decoration of hair; offers opportunities for the exercise of increased individual creativity in accomplishing decorative innovations in connection with the ornamentation of hair; provides new approaches to hair ornamentation, engendering widespread appeal.

The above objects and advantages, as well as further objects and advantages, are attained by the present invention which may be described briefly as a hair ornament retaining implement for being looped around and secured to multiple strands of hair of an individual so as to fasten an ornament to the hair to decorate the hair, the implement comprising: a band of resiliently deflectable material, the band having a loop establishing an inner eye within the loop and an entrance for admitting multiple strands of hair into the eye of the loop, and opposed legs extending longitudinally along the entrance and laterally outwardly in opposite directions so as to terminate at laterally spaced apart terminal ends; a knob at each terminal end for facilitating an intertwining of the opposed legs to close the entrance and cinch the loop around the multiple strands of hair so as to maintain the legs intertwined and secure the implement to the hair; and a coupling element located on at least one knob for coupling a hair ornament to the implement at the one knob to decorate the hair with the ornament retained on the implement, upon securing the implement to the hair.

In addition, the invention includes a decorative hair appliance for being secured to the hair of an individual to decorate the hair, the decorative hair appliance comprising: a plurality of hair ornament retaining implements, each implement constructed for being looped around and secured to multiple strands of the hair so as to fasten the implement to the hair, each implement comprising: a band of resiliently deflectable material, the band having a loop establishing an inner eye within the loop and an entrance for admitting multiple strands of hair into the eye of the loop, opposed legs extending longitudinally along the entrance and laterally outwardly in opposite directions so as to terminate at laterally spaced apart terminal ends; a knob at each terminal end for facilitating an intertwining of the opposed legs to close the entrance and cinch the loop around the multiple strands of hair so as to maintain the legs intertwined and secure the implement to the hair; and a coupling element located on at least one knob; and a cord coupled with the coupling element of at least one knob of each implement for extending between implements to decorate the hair with the cord retained on the implements, upon securing the implements to the hair.

Further, the invention includes a method for fastening an ornament to the hair of an individual to decorate the hair, the method comprising the steps of: admitting multiple strands of the hair into an eye established by a band of resiliently deflectable material, the band having a loop establishing the eye within the loop and an entrance for admitting the multiple strands of hair into the eye of the loop, opposed legs extending longitudinally along the entrance and laterally outwardly in opposite directions to terminate at laterally spaced apart terminal ends, and a knob at each terminal end; intertwining the opposed legs to close the entrance and cinch the loop around the multiple strands of hair so as to maintain the legs intertwined and to secure the implement to the hair; and coupling a hair ornament to at least one knob to retain the ornament on the implement for decorating the hair with the ornament upon securing the implement to the hair.

The invention will be understood more fully, while still further objects and advantages will become apparent, in the following detailed description of preferred embodiments of the invention illustrated in the accompanying drawing, in which.

Figure 1:
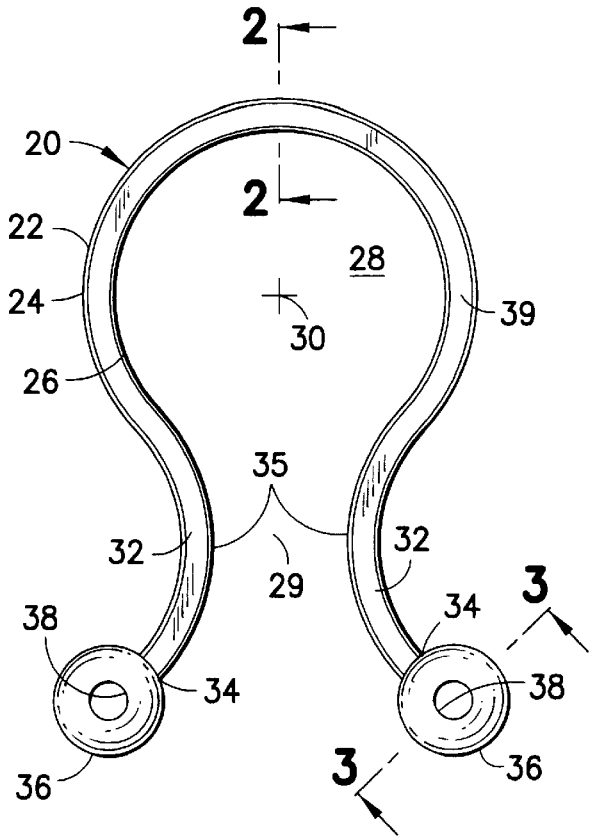
FIG. 1 is a plan view of a hair ornament retaining implement constructed in accordance with the present invention.
Figure 2:
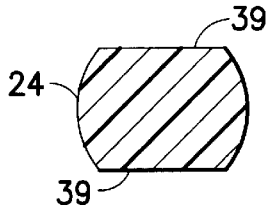
FIG. 2 is an enlarged cross-sectional view taken along line 2—2 of FIG. 1.
Figure 3:
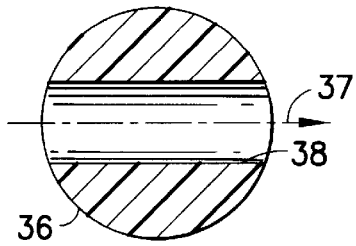
FIG. 3 is an enlarged cross-sectional view taken along line 3—3 of FIG. 1.

Referring now to the drawing, and especially to FIGS. 1 through 3 thereof, a hair ornament retaining implement constructed in accordance with the present invention is illustrated at 20 and is seen to have a body 22 including a band 24 of resiliently deflectable material extending in a longitudinal direction to form a loop 26 normally open to establish an inner eye 28 within the loop 26, the eye 28 having an entrance 29 and a transverse axis 30 (extending perpendicular to the plane of the paper in FIG. 1). A pair of laterally opposed legs 32 extend longitudinally from the loop 26 along the entrance 29 and terminate at laterally spaced apart terminal ends 34. The legs 32 are bowed so as to curve inwardly, toward one another, at 35 and then extend outwardly to the laterally spaced apart terminal ends 34. An enlarged knob 36 is placed at each terminal end 34 and a coupling element is located on at least one, and preferable on both knobs 36, coupling elements being illustrated in the form of an aperture 38 extending transversely into each knob 36, along a direction 37 essentially parallel to axis 30. Body 22 preferably is constructed of a synthetic polymeric material, such as polypropylene, and is advantageously molded in one piece, so that band 24, legs 32 and knobs 36 all are parts of a simple, economically manufactured unitary construction. In the embodiment illustrated in FIG. 1, the band 24 has a partially circular cross-sectional configuration, flattened along transversely opposite essentially flat faces 39, as seen in FIG. 2, the knobs 36 each are provided with an orbicular configuration, and each aperture 38 is in the form of a hole which extends fully through respective knob 36, as seen in FIG. 3.

Figure 4:
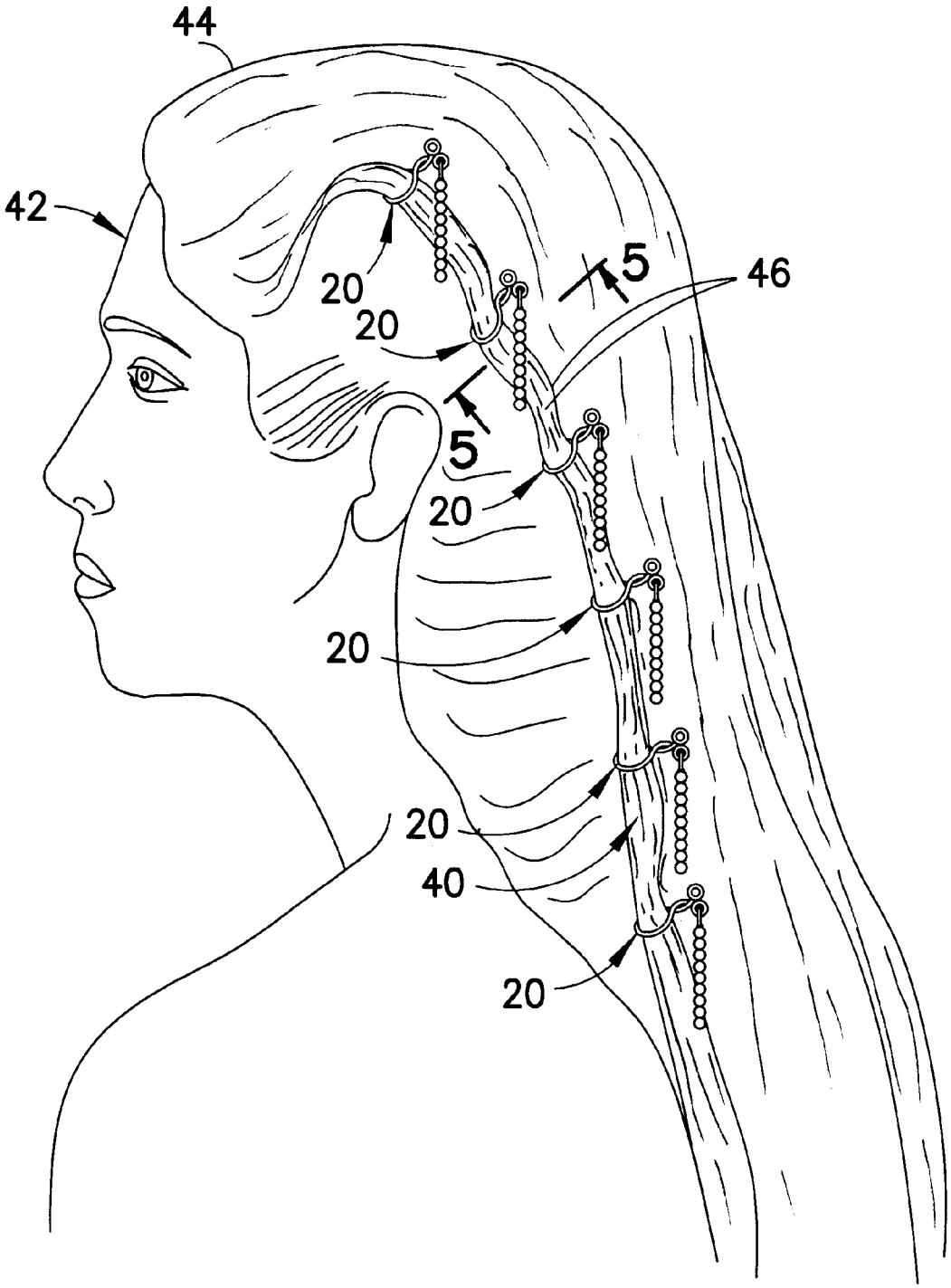
FIG. 4 is a pictorial view illustrating several hair ornament retaining implements in place in a person's hair.
Figure 5:
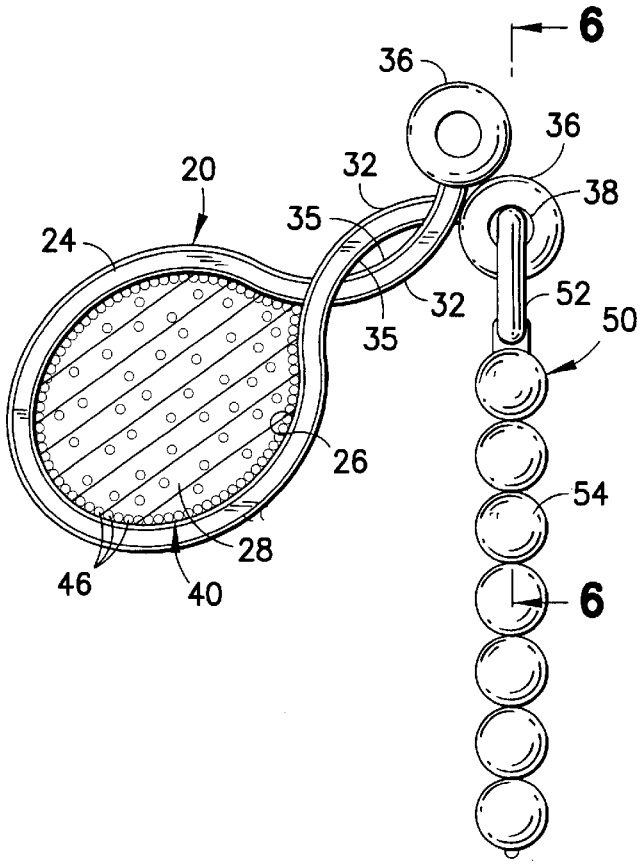
FIG. 5 is an enlarged view taken along line 5—5 of FIG. 4 and showing one of the implements of FIG. 4 secured to strands of hair at the person's head.

Turning now to FIGS. 4 and 5, implement 20 is secured to hair 40 of an individual 42, at the head 44 of the individual 42, by first admitting selected multiple strands 46 of hair 40 between the legs 32 of the implement 20, through the entrance 29, and into the eye 28 of the loop 26. Then, the legs 32 are intertwined, as seen in FIG. 5, to close the entrance 29 and loop 26, and cinch the band 24 around the multiple strands 46 of hair 40 so as to secure the implement 20 in place in the hair 40, the intertwining of the legs 32 being facilitated by the flattened partially circular cross-sectional configuration provided by transversely opposite essentially flat faces 39. The knobs 36 assist in enabling manipulation of the legs 32 into the intertwined position, and then act detent-like in concert with the bowed portions 35 of the legs 32 to maintain the closed cinch of the band 24 so that the implement 20 remains secured in place until selectively released by reversal of the above procedure to disengage the intertwined legs 32 from one another and open entrance 29.

Figure 6:
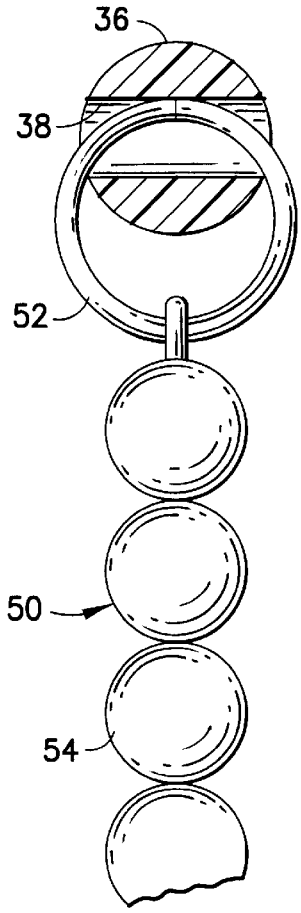
FIG. 6 is an enlarged fragmentary cross-sectional view taken along line 6—6 of FIG. 5.

A hair ornament is shown in the form of a bangle 50 which includes a ring 52 and a decorative beaded chain 54. As best seen in FIG. 6, the ring 52 carries the chain 54 and is engaged with aperture 38 in the knob by being threaded through the aperture 38 to couple the chain 54 to the knob 36 and, thus, to the implement 20. In this manner, the bangle 50 is retained simply and conveniently in any selected location along the hair 40.

Figure 7:
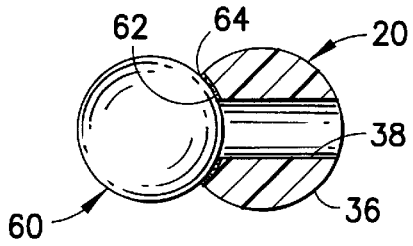
FIG. 7 is an enlarged fragmentary cross-sectional view similar to FIG. 6, but showing another alternate hair ornament.

As seen in FIG. 7, an alternate hair ornament in the form of a bead 60 is retained in the individual's hair by implement 20. In this embodiment, aperture 38 includes a seat 62 for the reception and engagement of bead 60 and coupling of bead 60 to knob 36 and, thus, to implement 20. In this instance, an adhesive 64 affixes the bead 60 within the seat 62.

Figure 8:
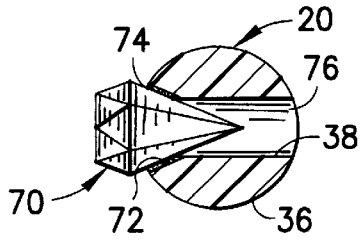
FIG. 8 is an enlarged fragmentary cross-sectional view similar to FIG. 6, but showing still another alternate hair ornament.

Another alternate hair ornament is shown in FIG. 8 in the form of a gemstone 70 seated within a seat 72 provided by aperture 38. Again, an adhesive 74 is employed to assure affixation of the gemstone 70 coupled with the knob 36; however, aperture 38 provides air space 76 behind the gemstone 70 to enable the desired refraction and total reflection of light within the gemstone 70.

Figure 9A:
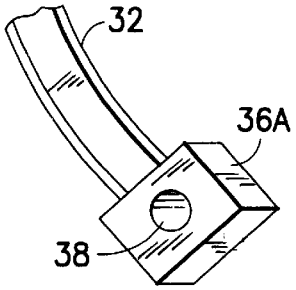
FIGS. 9A through 9E are fragmentary pictorial views illustrating alternate configurations of portions of the hair ornament retaining implement.
Figure 9B:
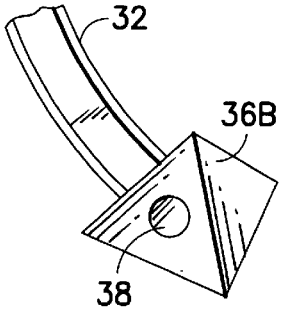
Figure 9C:
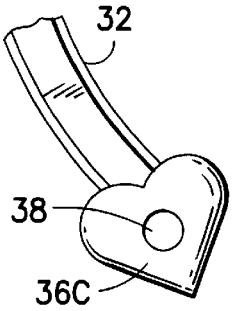
Figure 9D:
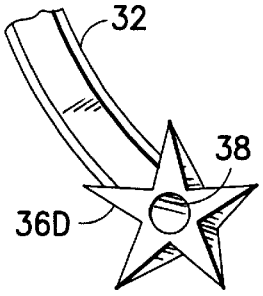
Figure 9E:
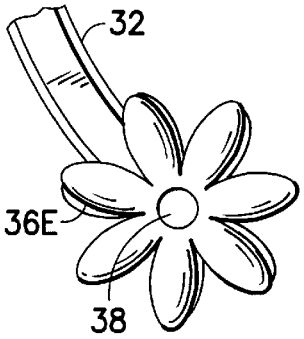

As another decorative alternative, knob 36 itself may be provided with any one of numerous ornamental configurations. As illustrated in FIGS. 9A through 9E, knob 36A in FIG. 9A has a cubic configuration, while in FIG. 9B knob 36B is provided with a pyramidal configuration. Knob 36C is seen in FIG. 9c to have a cardioid configuration, knob 36D is illustrated in FIG. 9D with a star-shaped configuration, and knob 36E is depicted in FIG. 9E with a floral configuration. It will be apparent that a variety of ornamental configurations can be formed integral with implement 20 by varying the configurations of knobs 36.

Figure 10:
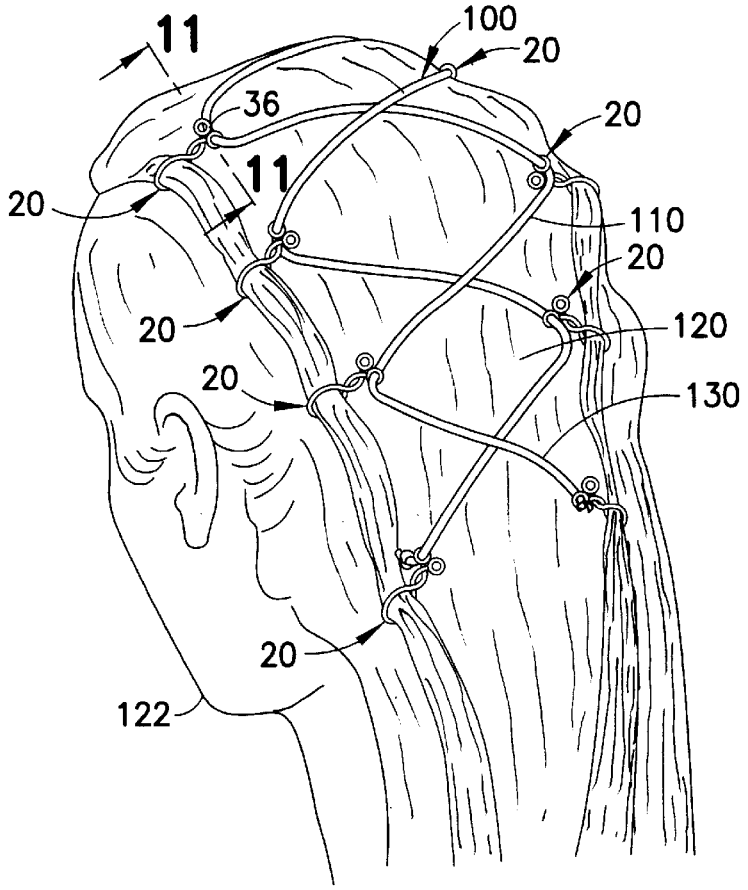
FIG. 10 is a pictorial view illustrating a decorative hair appliance constructed in accordance with the present invention in place in a persons's hair.
Figure 11:
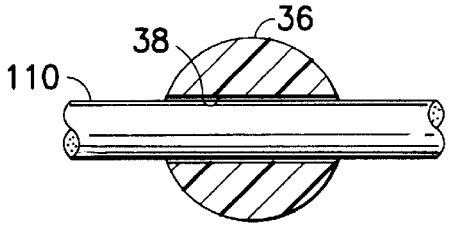
FIG. 11 is an enlarged fragmentary cross-sectional view taken along line 11—11 of FIG. 10.

Referring now to FIGS. 10 and 11, a hair appliance 100 utilizes a plurality of implements 20 to provide another decorative alternative. Thus, a decorative cord 110 is threaded through at least one aperture 38 of each one of the plurality of implements 20, as seen in FIG. 11, and the assembled implements 20 and cord 110 are arranged throughout hair 120 of individual 122, as illustrated in FIG. 10, so as to provide an integrated hair ornament 130 secured to the hair 120 of individual 122. In the preferred arrangement, decorative cord 110 is constructed of an elastic material so as to better follow any one of a myriad of aesthetic patterns established by selecting particular locations for the securement of implements 20 to hair 120 and routing the cord 110 to extend between the secured implements 20. In addition, cord 110 serves to hold hair 120 in place in selected hair arrangements, and that holding function is enhanced by the resilient expansion and contraction provided by an elastic cord 110.

It will be seen that the present invention attains all of the objects and advantages summarized above, namely: Provides exceptionally simple and highly effective implements and method for retaining ornaments in strands of a person's hair; allows convenient and economical decoration of a person's hair with a very wide variety of ornamental items; enables a very high degree of versatility in accomplishing a myriad of decorative effects for the hair, with minimal expense; attains new and unique aesthetic effects in the decoration of hair; offers opportunities for the exercise of increased individual creativity in accomplishing decorative innovations in connection with the ornamentation of hair; provides new approaches to hair ornamentation, engendering widespread appeal.

It is to be understood that the above detailed description of preferred embodiments of the invention is provided by way of example only. Various details of design, construction and procedure may be varied without departing from the true spirit and scope of the invention, as set forth in the appended claims.

The embodiments of the invention in which an exclusive property or privilege is claimed are defined as follows:

1. A hair ornament retaining implement for being looped around and secured to multiple strands of hair of an individual so as to fasten an ornament to the hair to decorate the hair, the implement comprising:

a band of resiliently deflectable material, the band having a loop establishing an inner eye within the loop and an entrance for admitting multiple strands of hair into the eye of the loop, and opposed legs extending longitudinally along the entrance and laterally outwardly in opposite directions so as to diverge and terminate at laterally spaced apart terminal ends and establish a resiliently intertwinable configuration in the resiliently deflectable divergent legs for closing the entrance and cinching the loop around the multiple strands of hair by intertwining of the resiliently deflectable opposed legs;

a knob at each terminal end for facilitating the intertwining of the opposed legs to close the entrance and cinch the loop around the multiple strands of hair so as to act in concert with the intertwined legs to maintain the legs intertwined and secure the implement to the hair; and a coupling element located on at least one knob for coupling a hair ornament to the implement at the one knob to decorate the hair with the ornament retained on the implement, upon securing the implement to the hair.

2. The implement of claim 1 wherein the legs are bowed to extend inwardly toward one another along the entrance and then outwardly away from one another at the terminal ends.

3. The implement of claim 1 wherein the coupling element comprises an aperture in the one knob.

4. The implement of claim 3 wherein the aperture extends fully through the one knob.

5. The implement of claim 4 wherein the eye has a transverse axis and the aperture extends along a transverse direction essentially parallel to the transverse axis.

6. The implement of claim 1 wherein the coupling element is located on each knob.

7. The implement of claim 6 wherein the coupling element comprises an aperture in each knob.

8. The implement of claim 7 wherein each aperture extends fully through each respective knob.

9. The implement of claim 8 wherein the eye has a transverse axis and each aperture extends along a transverse direction essentially parallel to the transverse axis.

10. The implement of claim 1 wherein each knob has a decorative shaped configuration.

11. The implement of claim 10 wherein the decorative shaped configuration is orbicular.

12. The implement of claim 10 wherein the decorative shaped configuration is selected from the group of decorative shaped configurations consisting of cubic, pyramidal, cardioid, star-shaped and floral.

13. The implement of claim 1 wherein the band has a partially circular cross-sectional configuration and includes transversely opposite essentially flat faces.

14. A decorative hair appliance for being secured to the hair of an individual to decorate the hair, the decorative hair appliance comprising:

a plurality of hair ornament retaining implements, each implement constructed for being looped around and secured to multiple strands of the hair so as to fasten the implement to the hair, each implement comprising:

a band of resiliently deflectable material, the band having a loop establishing an inner eye within the loop and an entrance for admitting multiple strands of hair into the eye of the loop, opposed legs extending longitudinally along the entrance and laterally outwardly in opposite directions so as to terminate at laterally spaced apart terminal ends;

a knob at each terminal end for facilitating an intertwining of the opposed legs to close the entrance and cinch the loop around the multiple strands of hair so as to maintain the legs intertwined and secure the implement to the hair; and a coupling element located on at least one knob; and a cord coupled with the coupling element of at least one knob of each implement for extending between implements to decorate the hair with the cord retained on the implements, upon securing the implements to the hair.

15. The appliance of claim 14 wherein the cord comprises an elastic cord.

16. The appliance of claim 14 wherein the coupling element comprises an aperture extending through the one knob and the cord is threaded through the aperture.

17. The appliance of claim 16 wherein the cord comprises an elastic cord.

18. A method for fastening an ornament to the hair of an individual to decorate the hair, the method comprising the steps of:

admitting multiple strands of the hair into an eye established by a band of resiliently deflectable material, the band having a loop establishing the eye within the loop and an entrance for admitting the multiple strands of hair into the eye of the loop, opposed legs extending longitudinally along the entrance and laterally outwardly in opposite directions to terminate at laterally spaced apart terminal ends, and a knob at each terminal end;

intertwining the opposed legs to close the entrance and cinch the loop around the multiple strands of hair so as to maintain the legs intertwined and to secure the implement to the hair; and coupling a hair ornament to at least one knob to retain the ornament on the implement for decorating the hair with the ornament upon securing the implement to the hair.

19. The method of claim 18 wherein the step of coupling the ornament to the one knob includes engaging the ornament with an aperture in the knob.

20. The method of claim 18 wherein the step of coupling the ornament to the one knob includes threading the ornament through an aperture in the knob.

* * * * *